US006444386B1

(12) United States Patent
Liu et al.

(10) Patent No.: US 6,444,386 B1
(45) Date of Patent: Sep. 3, 2002

(54) PHOTOCONDUCTIVE IMAGING MEMBERS

(75) Inventors: Ping Liu; Cheng-Kuo Hsiao; Beng S. Ong, all of Mississauga (CA); Timothy J. Fuller; Huoy-Jen Yuh, both of Pittsford, NY (US); Helen R. Cherniack, Rochester, NY (US); Markus R. Silvestri, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 13 days.

(21) Appl. No.: 09/834,292

(22) Filed: Apr. 13, 2001

(51) Int. Cl.[7] ..... G03G 5/14
(52) U.S. Cl. ..... 430/64
(58) Field of Search ..... 430/64

(56) References Cited

U.S. PATENT DOCUMENTS

| | | | | |
|---|---|---|---|---|
| 3,121,006 | A | 2/1964 | Middleton et al. | 96/1 |
| 4,265,990 | A | 5/1981 | Stolka et al. | 430/59 |
| 4,298,697 | A | 11/1981 | Baczek et al. | 521/27 |
| 4,338,390 | A | 7/1982 | Lu | 430/106 |
| 4,464,450 | A | 8/1984 | Teuscher | 430/59 |
| 4,555,463 | A | 11/1985 | Hor et al. | 430/59 |
| 4,560,635 | A | 12/1985 | Hoffend et al. | 430/106.6 |
| 4,587,189 | A | 5/1986 | Hor et al. | 430/59 |
| 4,921,769 | A | 5/1990 | Yuh et al. | 430/64 |
| 4,921,773 | A | 5/1990 | Melnyk et al. | 430/132 |
| 5,482,811 | A | 1/1996 | Keoshkerian et al. | 430/135 |
| 6,287,737 | B1 | 9/2001 | Ong et al. | 430/58.8 |

*Primary Examiner*—Mark Chapman
(74) *Attorney, Agent, or Firm*—E. D. Palazzo

(57) ABSTRACT

A photoconductive imaging member containing a supporting substrate, a hole blocking layer thereover, a photogenerating layer, and a charge transport layer, and wherein the hole blocking layer is generated from crosslinking an organosilane (I) in the presence of a hydroxy-functionalized polymer (II)

(I)

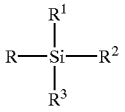

(II)

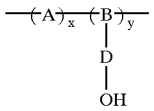

for example, wherein R is alkyl or aryl, $R^1$, $R^2$, and $R^3$ are independently selected from the group consisting of alkoxy, aryloxy, acyloxy, halide, cyano, and amino; A and B are respectively divalent and trivalent repeating units of polymer (II); D is a divalent linkage; x and y represent the mole fractions of the repeating units of A and B, respectively, and wherein x is from about 0 to about 0.99, and y is from about 0.01 to about 1, and wherein the sum of x+y is equal to about 1.

36 Claims, No Drawings

PHOTOCONDUCTIVE IMAGING MEMBERS

Illustrated in U.S. Pat. No. 6,287,737, the disclosure of which is totally incorporated herein by reference, is a photoconductive imaging member comprised of a supporting substrate, a hole blocking layer thereover, a photogenerating layer and a charge transport layer, and wherein the hole blocking layer is comprised of a crosslinked polymer generated, for example, from the reaction of a silyl-functionalized hydroxyalkyl polymer of Formula (I) with an organosilane of Formula (II) and water (I)

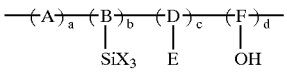

(II)

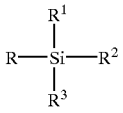

wherein, for example, A, B, D, and F represent the segments of the polymer backbone; E is an electron transporting moiety; Z is selected from the group consisting of chloride, bromide, iodide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl, with the substituent being halide, alkoxy, aryloxy, and amino; and $R^1$, $R^2$, and $R^3$ are independently selected from the group consisting of alkyl, aryl, alkoxy, aryloxy, acyloxy, haogen, cyano, and amino, subject to the provision that two of $R^1$, $R^2$, and $R^3$ are independently selected from the group consisting of alkoxy, aryloxy, acyloxy, and halide.

The appropriate components and processes of the above copending application may be selected for the present invention in embodiments thereof.

BACKGROUND OF THE INVENTION

This invention is generally directed to imaging members, and more specifically, the present invention is directed to multilayered photoconductive imaging members with a hole blocking layer comprised of an interpenetrating polymer network comprised of a hydroxyfunctionalized polymer intertwined or intimately dispersed in with a crosslinked polysiloxane network derived from an organosilane reagent, such as alkoxysilane, aminoalkylalkoxysilane, acyloxysilane, cyanosilane, and the like, in the presence of an optional silane crosslinking catalyst of, for example, alkylamine or carboxylic acid. The hole blocking layer is preferably in contact with the supporting substrate and is preferably situated between the supporting substrate and the photogenerating layer, which is comprised of the photogenerating pigments of U.S. Pat. No. 5,482,811, the disclosure of which is totally incorporated herein by reference, especially Type V hydroxygallium phthalocyanine. The imaging members of the present invention in embodiments exhibit excellent cyclic/environmental stability, and substantially no adverse changes in their performance over extended time periods, since the imaging members comprise a mechanically robust and solvent resistant hole blocking layer, enabling the coating of a subsequent photogenerating layer thereon without structural damage, and which blocking layer can be easily coated on the supporting substrate by various coating techniques of, for example, dip or slot-coating. The aforementioned photoresponsive, or photoconductive imaging members can be negatively charged when the photogenerating layers are situated between the hole transport layer and the hole blocking layer deposited on the substrate.

Processes of imaging, especially xerographic imaging and printing, including digital, are also encompassed by the present invention. More specifically, the layered photoconductive imaging members of the present invention can be selected for a number of different known imaging and printing processes including, for example, electrophotographic imaging processes, especially xerographic imaging and printing processes wherein charged latent images are rendered visible with toner compositions of an appropriate charge polarity. The imaging members as indicated herein are in embodiments sensitive in the wavelength region of, for example, from about 500 to about 900 nanometers, and in particular from about 650 to about 850 nanometers, thus diode lasers can be selected as the light source. Moreover, the imaging members of this invention are useful in color xerographic applications, particularly high-speed color copying and printing processes.

PRIOR ART

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

The use of perylene pigments as photoconductive substances is also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyl-diimide dual layered negatively charged photoreceptors with improved spectral response in the wavelength region of 400 to 700 nanometers. A similar disclosure is presented in Ernst Gunther Schlosser, Journal of Applied Photographic Engineering, Vol. 4, No. 3, page 118 (1978). There are also disclosed in U.S. Pat. No. 3,871,882, the disclosure of which is totally incorporated herein by reference, photoconductive substances comprised of specific perylene-3,4,9,10-tetracarboxylic acid derivative dyestuffs. In accordance with this patent, the photoconductive layer is preferably formed by vapor depositing the dyestuff in a vacuum. Also, there are disclosed in this patent dual layer photoreceptors with perylene-3,4,9,10-tetracarboxylic acid diimide derivatives, which have spectral response in the wavelength region of from 400 to 600 nanometers. Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methyl phenyl)-1,1'-biphenyl-4,4'-diamine dispersed in a polycarbonate binder, as a hole transport layer. The above components, such as the photogenerating compounds, and the aryl amine charge transport can be selected for the imaging members of the present invention in embodiments thereof.

In U.S. Pat. No. 4,921,769, the disclosure of which is totally incorporated herein by reference, there are illustrated photoconductive imaging members with blocking layers of certain polyurethanes. Advantages of the hole blocking layer of the present invention over that of the '769 patent include, for example, excellent resistance to solvent degradation, superior electron transport and hole blocking, and ease of fabrication of the blocking layers, and wherein the blocking layer can be comprised of a crosslinked polymer network impregnated with a water-miscible hydroxy-functionalized polymer, thus enabling the addition of water to the blocking layer coating solution without causing, or minimizing phase separation during the coating process. Water can be an important reagent in alkoxysilane condensation reactions.

SUMMARY OF THE INVENTION

It is a feature of the present invention to provide imaging members with many of the advantages illustrated herein such as a rapid curing of the hole blocking layer during device fabrication, for example of about equal to, or less than about one minute, for example from about 5 to about 60 seconds, and which layer prevents, or minimizes dark injection, and wherein the resulting photoconducting members possess, for example, excellent photoinduced discharge characteristics, cyclic and environmental stability and acceptable charge deficient spot levels arising from dark injection of charge carriers.

Another feature of the present invention relates to the provision of layered photoresponsive imaging members, which are responsive to near infrared radiation of from about 700 to about 900 nanometers.

It is yet another feature of the present invention to provide layered photoresponsive imaging members with a sensitivity to visible light, and which members possess improved coating characteristics, and wherein the charge transport molecules do not diffuse, or there is minimum diffusion thereof into the photogenerating layer.

Moreover, another feature of the present invention relates to the provision of layered photoresponsive imaging members with mechanically robust and solvent resistant hole blocking layers.

In a further feature of the present invention there are provided imaging members containing hole blocking polymer layers comprised of a crosslinked polysiloxane polymer network impregnated with a hydroxy-functionalized polymer, and photogenerating pigments of, for example, Type V hydroxygallium phthalocyanine.

Aspects of the present invention relate to a photoconductive imaging member comprised of a supporting substrate, a hole blocking layer thereover, a photogenerating layer and a charge transport layer, and wherein the hole blocking layer is comprised of a hydroxy-functionalized polymer intertwined in a crosslinked polysiloxane network generated from crosslinking an organosilane reagent represented by Formula (I) or (II) below, optionally in the presence of a suitable silane crosslinking catalyst of, for example, an organoamine of, for example, triethylamine or carboxylic acid of, for example, acetic acid (I)

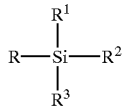

wherein R is alkyl with, for example, from about 1 to about 20 carbon atoms, or aryl with, for example, from about 6 to about 30 carbon atoms; $R^1$, $R^2$, and $R^3$ are each independently selected from the group consisting of, for example, alkoxy of, for example, from about 1 to about 12 carbon atoms, aryloxy of, for example, from about 6 to about 24 carbon atoms, acyloxy of, for example, from about 2 to about 20 carbon atoms, halide, cyano, amino, and the like.

In accordance with aspects of the present invention, there is provided a photoconductive imaging member comprised of a supporting substrate, a hole blocking layer thereover, a photogenerating layer, and a charge transport layer, and wherein the hole blocking layer is generated from crosslinking an organosilane (I) in the presence of a hydroxy-functionalized polymer (II)

(I)

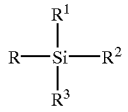

(II)

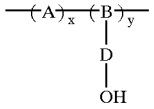

wherein R is alkyl or aryl, $R^1$, $R^2$, and $R^3$ are each independently selected from the group consisting of alkoxy, aryloxy, acyloxy, halide, cyano, and amino; A and B are, respectively, divalent and trivalent repeating segments or units of polymer (II); D is a divalent linkage; x and y represent the mole fractions of the repeating units of A and B, respectively, with x being from, for example, about 0 to about 0.99, more specifically, from about 0.3 to about 0.7 and y being from about 0.01 to about 1, and more specifically, from about 0.1 to about 0.75, and wherein the sum of x+y is equal to about 1; an imaging or photoconductive member wherein the organosilane (I) is selected from the group consisting of methyltrichlorosilane, methyltrimethoxysilane, methyltriethoxysilane, ethyltrichlorosilane, ethyltrimethoxysilane, ethyltriethoxysilane, propyltrimethoxysilane, 3-aminopropyltrimethoxysilane, 3-aminopropyltriethoxysilane, and the like; an imaging member wherein A is selected from the group consisting of

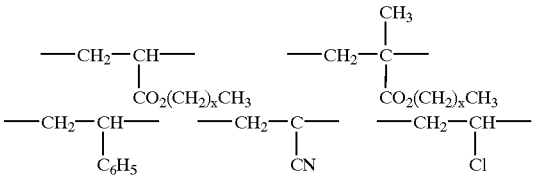

and B is selected from the group consisting of

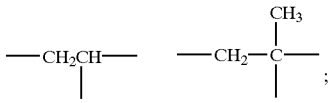

an imaging member wherein D is arylene, aryleneoxycarbonyl, or alkyleneoxycarbonyl; wherein polymer (III) of the following Formula is selected as the hydroxyfunctionalized polymer (II)

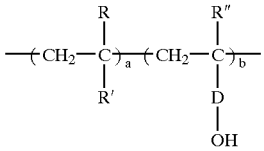

(III)

wherein R and R" are independently selected from the group consisting of hydrogen, alkyl, aryl, halogen, and the like; R' is aryl, cyano, halogen, alkoxycarbonyl, aryloxycarbonyl; D is divalent linkage preferably selected from the group consisting of arylene, alkylenearyl, alkyleneoxycarbonyl, aryleneoxycarbonyl, alkylenearyloxycarbonyl; a and b are mole fractions of the repeating units of the polymer such that the sum of a+b=1; an imaging member wherein a is from about 0 to about 0.99, and b is from 0.01 to about 1 and wherein a+b=1; an imaging member wherein R and R" are independently selected from hydrogen and alkyl, such as methyl, and R' is alkoxycarbonyl; an imaging member wherein R' is methoxycarbonyl, ethoxycarbonyl, propoxycarbonyl, or butoxycarbonyl; an imaging member wherein D is alkyleneoxycarbonyl or alkylenearyloxycarbonyl; an imaging member wherein $M_n$, number average molecular weight of (III) is, for example, from about 1,000 to about 50,000, and $M_w$, weight average molecular weight is, for example, from about 10,000 to about 200,000; an imaging member wherein $M_n$ of (III) ranges from about 5,000 to about 20,000, and $M_w$ ranges from about 15,000 to about 75,000; an imaging member wherein organosilane (I) is selected from the group consisting of methyltrichlorosilane, methyltrimethoxysilane, methyltriethoxysilane, ethyltrichlorosilane, ethyltrimethoxysilane, ethyltriethoxysilane, propyltrimethoxysilane, 3-aminopropyltrimethoxysilane, 3-aminopropyl triethoxysilane, and the like; an imaging member wherein the organosilane (I) is 3-aminoalkyltrialkoxysilane; an imaging member wherein the organosilane (I) is 3-aminopropyltrialkoxysilane; an imaging member wherein the organosilane (I) is 3-aminopropyltrimethoxysilane or 3-aminopropyltriethoxysilane; an imaging member wherein alkyl contains from 1 to about 15 carbon atoms; an imaging member wherein alkyl contains from about 1 to about 10 carbon atoms; an imaging member wherein alkoxy contains from 1 to about 10 carbon atoms; an imaging member wherein the hydroxy-functionalized polymer (III) is selected from the group consisting of (III-a) through (III-h); a photoconductive imaging member wherein (III-a), (III-b), or (III-c) is selected, and wherein a and b are each from about 0.2 to about 0.8; a photoconductive imaging member wherein (III-d), (III-e), (III-f), (III-g), or (III-h) is selected, and wherein a and b are each from about 0.2 to about 0.8, and the sum thereof is about 1 ;a photoconductive imaging member wherein the organosilane (I) is 3-aminopropyltrimethoxysilane, 3-aminopropyl triethoxysilane, or mixtures thereof; a photoconductive imaging member wherein the hole blocking layer is of a thickness of about 0.001 to about 5 microns, or is of a thickness of about 0.1 to about 5 microns; a photoconductive imaging member comprised in the sequence of a supporting substrate, a hole blocking layer, an adhesive layer, a photogenerating layer and a charge transport layer; a photoconductive imaging member wherein the adhesive layer is comprised of a polyester with an $M_w$ of about 70,000, and an $M_n$ of about 35,000; a photoconductive imaging member wherein the supporting substrate is comprised of a conductive metal substrate; a photoconductive imaging member wherein the conductive substrate is aluminum, aluminized polyethylene terephthalate or titanized polyethylene; a photoconductive imaging member wherein the photogenerator layer is of a thickness of from about 0.05 to about 10 microns; a photoconductive imaging member wherein the charge, such as hole transport layer, is of a thickness of from about 10 to about 50 microns; a photoconductive imaging member wherein the photogenerating layer is comprised of photogenerating pigments dispersed in a resinous binder in an amount of from about 5 percent by weight to about 95 percent by weight; a photoconductive imaging member wherein the resinous binder is selected from the group consisting of polyesters, polyvinyl butyrals, polycarbonates, polystyrene-b-polyvinyl pyridine, and polyvinyl formals; a photoconductive imaging member wherein the charge transport layers comprise aryl amine molecules; a photoconductive imaging wherein the charge transport aryl amines are of the formula

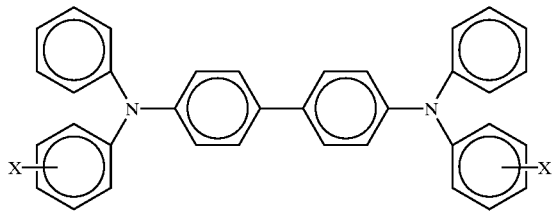

wherein X is selected from the group consisting of alkyl and halogen, and wherein the aryl amine is dispersed in a resinous binder; a photoconductive imaging member wherein for the aryl amine alkyl is methyl, wherein halogen is chlorine, and wherein the resinous binder is selected from the group consisting of polycarbonates and polystyrene; a photoconductive imaging member wherein the aryl amine is N,N'-diphenyl-N,N-bis(3-methyl phenyl)-1,1'-biphenyl-4,4'-diamine; a photoconductive imaging member further including an adhesive layer of a polyester with an $M_w$ of about 70,000, and an $M_n$ of about 35,000; a photoconductive imaging member wherein the photogenerating layer is comprised of metal phthalocyanines, or metal free phthalocyanines; a photoconductive imaging member wherein the photogenerating layer is comprised of titanyl phthalocyanines, perylenes, or hydroxygallium phthalocyanines; a photoconductive imaging member wherein the photogenerating layer is comprised of Type V hydroxygallium phthalocyanine; a method of imaging which comprises generating an electrostatic latent image on the imaging member illustrated herein, developing the latent image, and transferring the developed electrostatic image to a suitable substrate; a photoconductive imaging member wherein there is accomplished crosslinking in the presence of a catalyst such as, for example, a catalyst selected from the group consisting of carboxylic acids and amines; a photoconductive imaging member wherein acetic acid or an alkylamine is selected as the catalyst for the preparation of the hole blocking layer; a photoconductive imaging wherein the catalyst is propylamine or butylamine is selected; a photoconductive imaging wherein the catalyst for the preparation of the hole blocking layer is selected in the amount of about 0.01 to about 10 weight percent of the amount of organosilane (I); and a photoconductive imaging member comprised of a supporting substrate, a hole blocking layer thereover, a photogenerating layer, and a charge transport layer, and wherein the hole blocking layer is generated from crosslinking an organosilane (I) in the presence of a hydroxy-functionalized polymer (II)

(I)

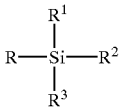

(II)

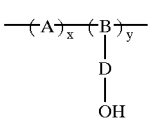

wherein R is a suitable group or radical, such as alkyl with, for example, from about 1 to about 20 carbon atoms, aryl with, for example, from about 6 to about 30 carbon atoms and the like; $R^1$, $R^2$, and $R^3$ are, for example, independently selected from the group consisting of alkoxy with, for example, from about 1 to about 12 carbon atoms, aryloxy with, for example, from about 6 to about 24 carbon atoms, acyloxy with, for example, from about 2 to about 20 carbon atoms, halide, cyano, amino, and the like; A and B are, respectively, divalent and trivalent repeating segments of the polymer (II), for example, from about 2 to about 30 carbon atoms; D is a divalent linkage with, for example, from about 2 to about 30 carbon atoms such as arylene, aryleneoxycarbonyl, alkyleneoxycarbonyl, and the like; x and y are suitable mole fractions of the repeating units of A and B, respectively, wherein x is, for example, from about 0 to about 0.99, and y is, for example, from about 0.01 to about 1, and wherein the sum of x and y is about 1.

The hole blocking layers for the imaging members of the present invention are, for example, derived by crosslinking an organosilane reagent (I) in the presence of a hydroxy-functionalized polymer. The use of the hydroxy-functionalized polymer permits, for example, the addition of water into the hole blocking layer coating solution without, or minimizing phase separation. Water is usually present to permit the full crosslinking or curing of the organosilane (I) since usually the crosslinking reaction involves hydrolysis of (I) to provide the hydroxysilyl function (—Si—OH), which then undergoes self-condensation to provide a Si-O-Si bond as schematically represented in Scheme 1

Scheme 1

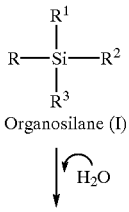

-continued

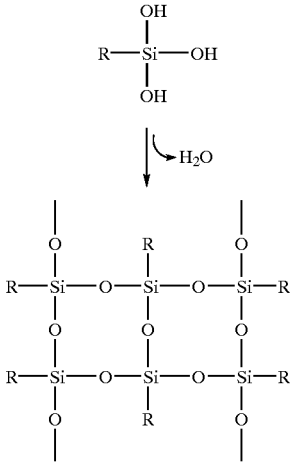

wherein R, $R^1$, $R^2$, and $R^3$ are substituents as indicated herein. The amount of crosslinking can vary depending on the reactants, for example; generally however, it is believed that from about 20 to about 95 percent of crosslinking can be accomplished.

Illustrative examples of organosilanes (I) or (I) include alkyl silanes, alkoxy silanes, amino silanes, alkylhalosilanes, aminoalkylalkoxysilanes, and more specifically for example, methyltrichlorosilane, methyltrimethoxysilane, methyltriethoxysilane, ethyltrichlorosilane, ethyltrimethoxysilane, ethyltriethoxysilane, propyltrimethoxysilane, 3-aminopropyltrimethoxysilane, 3-aminopropyl triethoxysilane, and the like.

In embodiments of the present invention, the hydroxy-functionalized polymer can be illustrated with reference to the general Formula (II)

(II)

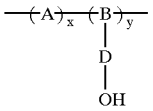

wherein A and B are, respectively, divalent and trivalent repeating units of the polymer; D is a divalent linkage such as arylene, aryleneoxycarbonyl, alkyleneoxycarbonyl, and the like; m and n are the mole fractions of the repeating units of A and B, respectively, wherein x is, for example, from about 0 to about 0.99, and more specifically, from about 0.1 to about 0.9, and y is, for example, from about 0.01 to about 1, and more specifically, from about 0.1 to about 0.9, and wherein x+y is equal to 1.

Specific illustrative examples of A wherein x represents the number of repeating segments, such as from 1 to about 25, are

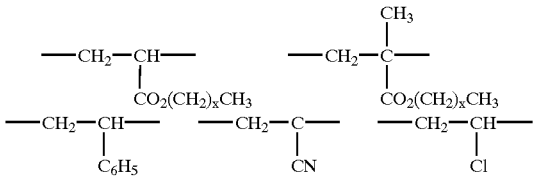

Specific illustrative examples of B are

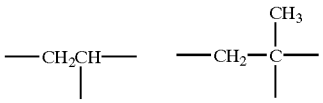

and specific illustrative examples of D are $$—CO_2\ (CH_2)_p—$$

wherein p is, for example, a number of from about 2 to about 15;

$—CO_2CH_2CH(CH_3)CH_2—$; $—CO_2CH_2CH_2CH(CH_3)CH_2—$; $—CO_2CH_2CHClCH_2—$;

$—C_6H_4—$; $—C_6H_3Cl—$; $—C_6H_3(CH_3)—$; $—CO_2C_6H_4—$; $—CO_2C_6H_3Cl—$; $—CO_2C_6H_3(CH_3)—$.

The hydroxy-functionalized polymer that can be selected for the preparation of the hole blocking layer or layers of the present invention is illustrated with reference to Formula (III)

(III)

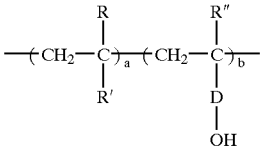

wherein R and R" are, for example, independently selected from the group consisting of hydrogen, alkyl, aryl, halogen, and the like; R' is aryl, cyano, halogen, alkoxycarbonyl, aryloxycarbonyl, and the like; D is, for example, selected from the group consisting of arylene, alkylenearyl, alkyleneoxycarbonyl, aryleneoxycarbonyl, alkylenearyloxycarbonyl, and the like; a and b are as indicated herein, and more specifically, represent mole fractions of the repeating units of the polymer.

More specifically, the hydroxy-functionalized polymers (III) that are utilized in the hole blocking layers of the present invention are selected from the group consisting of polymers (III-a) through (III-h)

(III-a)

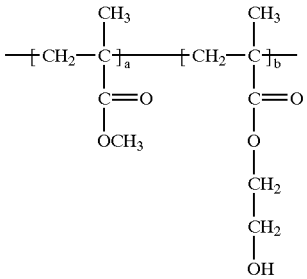

-continued (III-b)

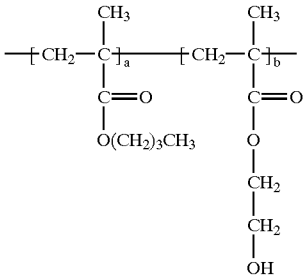

(III-c)

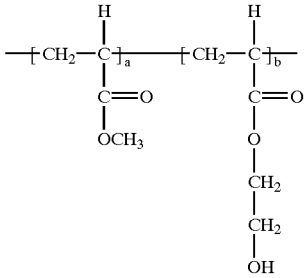

(III-d)

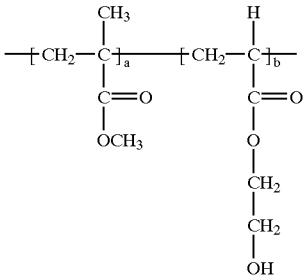

(III-e)

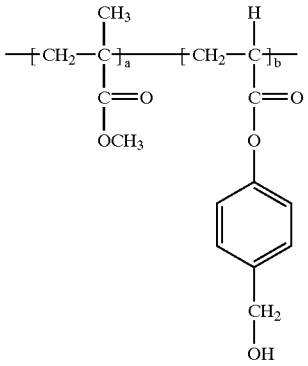

-continued (III-f)

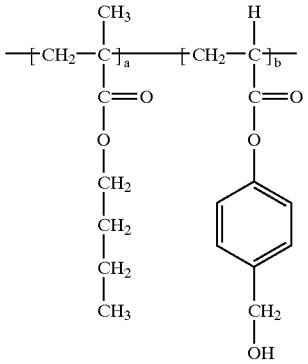

(III-g)

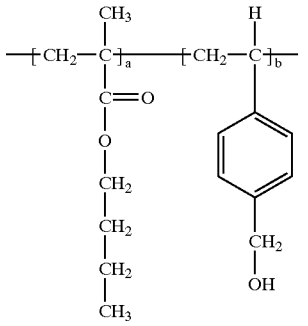

(III-h)

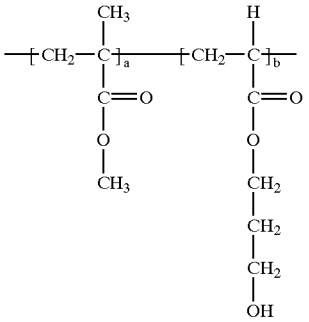

wherein a is from about 0 to about 0.99, and b is from about 0.01 to about 1.0, and wherein the sum of a and b is equal to 1.

Polymer (III) that can be utilized in the hole blocking layers of the photoconductive imaging members of the present invention can be prepared by free radical polymerization according to Scheme 2 wherein the substituents are as illustrated herein. Specifically, this polymer can be prepared by polymerization of a mixture of vinyl monomers (IV) and (V) in the presence of a suitable radical initiator such as benzoyl peroxide, 2,2'-azobis(2-methylpropanenitrile), and the like. The polymerization is generally accomplished in an inert solvent such as toluene, benzene, tetrahydrofuran, chloroform, or the like at a temperature of between about 30° C. to about 120° C. A specific preparative procedure for polymer (III) is as follows. A mixture of monomers (IV) and (V) in effective molar equivalent amounts and a solvent, such as toluene or tetrahydrofuran, are first charged to a reactor. The mixture is stirred at a temperature ranging, for example, from ambient to about 70° C. for about 5 to 30 minutes. Subsequently, an initiator, such as 2,2'-azobis(2-methylpropanenitrile), is added and the mixture is heated at about 50° C. to about 100° C. for a suitable period of time, for example from 1 to about 24 hours to complete the polymerization. After the polymerization, the reaction mixture is diluted with a solvent, such as toluene or tetrahydrofuran, and poured into, for example, hexane to precipitate the polymer product. The latter is collected by filtration and dried in vacuo to provide polymer (III), which is characterized by gel permeation chromatography (GPC), and other relevant spectroscopic techniques such as IR and NMR spectroscopy:

Scheme 2

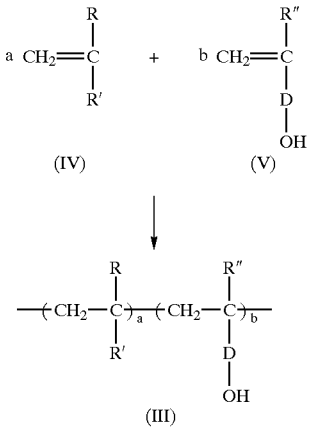

Specific embodiments of the present invention relate to a photoconductive imaging member wherein the hole blocking layer is of a thickness of about 0.001 to about 5 microns; a photoconductive imaging member wherein the hole blocking layer is of a thickness of about 0.1 to about 5 microns; a photoconductive imaging member wherein the blocking polymer is derived from a hydroxy-functionalized polymer (II) and an organosilane (I) selected from the group consisting of alkylhalosilanes, alkylalkoxysilanes, aminoalkylsilanes, and the like, such as methyltrichlorosilane, methyltrimethoxysilane, methyltriethoxysilane, ethyltrichlorosilane, ethyltrimethoxysilane, ethyltriethoxysilane, propyltrimethoxysilane, 3-aminopropyltrimethoxysilane, 3-aminopropyl triethoxysilane, and the like; a photoconductive imaging member wherein the organosilane (I) is 3-aminopropyltrimethoxysilane or 3-aminopropyl triethoxysilane; a photoconductive imaging member comprised in the following sequence of a supporting substrate, a hole blocking polymer network layer prepared from organosilane (I) and polymer (II) as illustrated herein, an adhesive layer, a photogenerating layer and a charge transport layer; a photoconductive imaging member wherein the adhesive layer is comprised of a polyester with an $M_w$ of, for example, from about 20,000 to about 100,000, and more specifically, about 35,000, and an $M_n$ of from about 10,000 to 50,000, and more specifically, about 14,000; a photoconductive imaging member wherein the supporting substrate is comprised of a conductive metal substrate; a photoconductive imaging member wherein the conductive substrate is aluminum, aluminized or titanized polyethylene terephthalate belt (MYLAR®); a photoconductive imaging member wherein the photogenerator layer is of a thickness of from about 1 to about 10 microns; a photoconductive imaging member wherein the transport layer is of a thickness of from about 10 to about 75 microns; a photoconductive imaging member wherein the photogenerating layer is comprised of photogenerating pigments dispersed in a resinous binder in an amount of from about 10 percent by weight to about 95 percent by weight; a photoconductive imaging member wherein the resinous binder is selected from the group consisting of polyesters, polyvinyl butyrals, polycarbonates, polystyrene-b-polyvinyl pyridines, and polyvinyl formals; a photoconductive imaging member wherein the charge transport layer comprises aryl amine molecules; a photoconductive imaging member wherein the aryl amines are of the formula

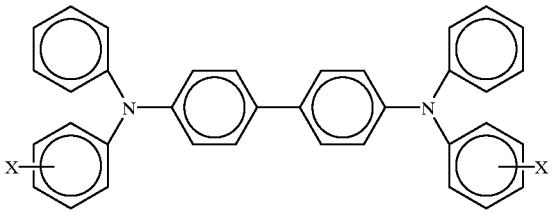

wherein X is selected from the group consisting of alkyl and halogen, and wherein the aryl amine is dispersed in a highly insulating and transparent resinous binder; a photoconductive imaging member wherein the arylamine alkyl contains from about 1 to about 12 carbon atoms; a photoconductive imaging member wherein the arylamine alkyl contains from 1 to about 5 carbon atoms; a photoconductive imaging member wherein the arylamine alkyl is methyl, wherein halogen is chloride, and wherein the resinous binder is selected from the group consisting of polycarbonates and polystyrenes; a photoconductive imaging member wherein the aryl amine is N,N'-diphenyl-N,N-bis(3-methylphenyl)-1,1'-biphenyl-4,4'-diamine; a photoconductive imaging member further including an adhesive layer of a polyester with an $M_w$ of about 70,000, and an $M_n$ of from about 25,000 to about 50,000, and more specificially about 35,000; a photoconductive imaging member wherein the photogenerating layer is comprised of metal phthalocyanines, metal free phthalocyanines or mixtures thereof; a photoconductive imaging member wherein the photogenerating layer is comprised of titanyl phthalocyanines, perylenes, such as BZP, or hydroxygallium phthalocyanines; a photoconductive imaging member wherein the photogenerating layer is comprised of Type V hydroxygallium phthalocyanine; a method of imaging which comprises generating an electrostatic latent image on the imaging member, developing the latent image with a know dry toner, and transferring the developed electrostatic image to a suitable substrate; a photoconductive imaging member wherein the blocking layer is derived from the reaction of organosilane (I) in the presence of hydroxy-functionalized polymer (II) and an optional catalyst selected from the group consisting of carboxylic acids and amines; a photoconductive imaging member wherein acetic acid or an alkylamine is selected as the catalyst; an imaging member wherein an interpenetrating hydroxy-functionalized polymer (II)/polysiloxane network is selected as a hole blocking layer, and is generated from the hydrolysis and polycondensation of organosilane (I) in the presence of (II); and imaging members comprised of a supporting substrate, an interpenetrating polysiloxane/hydroxy-functionalized polymer network blocking layer, thereover, a photogenerating layer of, for example, hydroxygallium phthalocyanine, and a charge transport layer.

Illustrative examples of monomer (IV) selected for the preparation of polymer (III) include, for example, acrylonitrile, vinyl chloride, styrene, methyl styrene, chlorostyrene, acrylic and methacrylic esters such as methyl acrylate, ethyl acrylate, propyl acrylate, butyl acrylate, methyl methacrylate, ethyl methacrylate, propyl methacrylate, butyl methacrylate, phenyl acrylate, phenyl methacrylate, and the like. Illustrative examples of monomer (V) include, for example, 2-hydroxyethyl methacrylate, hydroxypropyl methacrylate, 2-hydroxyethyl arylate, hydroxypropyl acylate, 4-hydroxybutyl acrylate, 2-allyphenol, allyl alcohol, 2-allyl-6-methoxyphenol, 4-allyl-2-methoxyphenol, 4-ally-2,6-dimethoxypyhenol, and the like.

Specifically, the preparation of the hole blocking layers of the present invention involves coating a solution of polymer (III), organosilane (I), optional catalyst, and water in a suitable solvent onto a supporting substrate. The coated layer is then thermally dried and cured at elevated temperatures. The curing or crosslinking can generally be accomplished at, for example, about 40° C. to about 200° C., and preferably from about 80° C. to about 150° C. for a suitable time period such as from about 0.1 minute to about 2 hours. The crosslinking processes, as schematically illustrated in Scheme 1, involves the hydrolysis of the silyl groups of organosilane (I) to the corresponding hydroxysilyl functions, followed by condensation to form the siloxane (Si—O—Si) bonds. It is preferred that water, for example from about 0.001 to about 10 weight percent, be present in the coating solution to fully effect the hydrolysis for the crosslinking reaction. Trace amounts of water, such as for example about 0.01 percent by weight of solvent that are present in the coating solvents, may often be sufficient to induce the hydrolysis reaction. Additionally, curing or crosslinking of the coated blocking layers may also be induced to occur by humidification via exposing to a moist atmosphere prior to or during thermal treatment.

Illustrative examples of substrate layers selected for the imaging members of the present invention can be opaque or substantially transparent, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, or of minimum thickness providing there are no significant adverse effects on the member. In embodiments, the thickness of this layer is from about 75 microns to about 300 microns.

The photogenerating layer, which can be comprised of hydroxygallium phthalocyanine Type V, is in embodiments comprised of, for example, about 50 weight percent of the Type V and about 50 weight percent of a resin binder like polystyrene/polyvinylpyridine. The photogenerating layer can contain known photogenerating pigments, such as metal phthalocyanines, metal free phthalocyanines, hydroxygallium phthalocyanines, perylenes, especially bis (benzimidazo)perylene, titanyl phthalocyanines, and the like, and more specifically vanadyl phthalocyanines, Type V hydroxygallium phthalocyanines, and inorganic components such as selenium, especially trigonal selenium. The photogenerating pigment can be dispersed in a resin binder similar to the resin binders selected for the charge transport layer, or alternatively no resin binder is needed. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 10 microns, and more specifically, from about 0.25 micron to about 2 micron when, for example, the photogenerator compositions are present in an amount of from about 30 to about 75 percent by volume. The maximum thickness of this layer in embodiments is dependent primarily upon factors, such as photosensitivity, electrical properties and mechanical considerations. The photogenerating layer binder resin, present in various suitable amounts, for example from about 1 to about 50, and more specifically, from about 1 to about 10 weight percent, may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. It is desirable to select a coating solvent that does not substantially disturb or adversely effect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layers in embodiments of the present invention can be accomplished with spray, dip or wire-bar methods such that the final dry thickness of the photogenerator layer is, for example, from about 0.01 to about 30 microns and more specifically from about 0.1 to about 15 microns after being dried at, for example, about 40° C. to about 150° C. for about 15 to about 90 minutes.

Illustrative examples of polymeric binder materials that can be selected for the photogenerator layer are as indicated herein, and include those polymers as disclosed in U.S. Pat. No. 3,121,006, the disclosure of which is totally incorporated herein by reference. In general, the effective amount of polymer binder that is utilized in the photogenerator layer ranges from about 0 to about 95 percent by weight, and preferably from about 25 to about 60 percent by weight of the photogenerator layer.

As optional adhesive layers usually in contact with the hole blocking layer, there can be selected various known substances inclusive of polyesters, polyamides, poly(vinyl butyral), poly(vinyl alcohol), polyurethane and polyacrylonitrile. This layer is, for example, of a thickness of from about 0.001 micron to about 1 micron. Optionally, this layer may contain effective suitable amounts, for example from about 1 to about 10 weight percent, conductive and nonconductive particles, such as zinc oxide, titanium dioxide, silicon nitride, carbon black, and the like, to provide, for example, in embodiments of the present invention further desirable electrical and optical properties.

Aryl amines selected for the charge, especially hole transporting layers, which generally are of a thickness of from about 5 microns to about 75 microns, and preferably of a thickness of from about 10 microns to about 40 microns, include molecules of the following formula

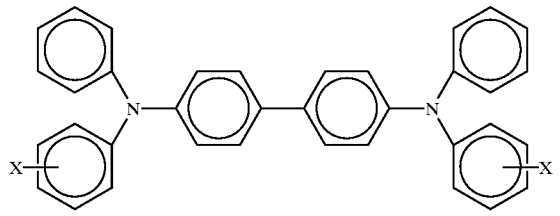

dispersed in a highly insulating and transparent polymer binder, wherein X is an alkyl group, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

Examples of the highly insulating and transparent polymer binder materials for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the transport layer contains from about 10 to about 75 percent by weight of the charge transport material, and preferably from about 35 percent to about 50 percent of this material.

Also, included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples and data are also provided.

EXAMPLE I

Synthesis of Polymer (III-a) With a=0.30, b=0.70:

To a 1 liter three-neck round-bottomed flask, under a nitrogen blanket, were added 15.02 grams of methyl methacrylate, 45.55 grams of 2-hydroxyethyl methacrylate, 300 milliliters of tetrahydrofuran and 85 milliliters of ethanol. The resulting mixture was stirred at about 30° C. for 10 minutes, followed by the addition of 0.632 gram of 2,2'-azobis(isobutyronitrile) initiator. The mixture resulting was subsequently stirred and refluxed for 24 hours at temperature of about 85° C. The resulting polymer solution was diluted with 500 milliliters of tetrahydrofuran at room temperature, about 25° C. throughout, and was then added into 5,000 milliliters of hexane with stirring to precipitate the polymer product. The solid product, polymer (III-a), was collected by filtration and dried at room temperature in vacuo for 24 hours to provide 55.7 grams (91 percent) of polymer (III-a). The polymer displayed an $M_w$ of 35,704 and an $M_n$ of 15,504, both as measured by GPC.

EXAMPLE II

Synthesis of Polymer (III-a) With a=0.70 and b=0.30:

This polymer was prepared in accordance with the procedure of Example I except that 35.04 grams of methyl methacrylate, 19.52 grams of 2-hydroxyethyl methacrylate, 400 milliliters of tetrahydrofuran, and 0.657 grams of 2,2'-azobis(isobutyronitrile) initiator were utilized. The yield was 50 grams (91.6 percent).

The polymer displayed an $M_w$ of 29,620 and an $M_n$ of 13,703 as measured by GPC.

EXAMPLE III

Synthesis of Polymer (III-a) With a=50 and b=0.50:

This polymer was prepared in accordance with the procedure of Example II except that 25.03 grams of methyl methacrylate, 32.54 grams of 2-hydroxyethyl methacrylate, 300 milliliters of tetrahydrofuran, 85 milliliters of ethanol, and 0.63 gram of 2,2'-azobis(isobutyronitrile) initiator were utilized. The yield was 52.4 grams (91.0 percent).

The polymer displayed an $M_w$ of 34,425 and an $M_n$ of 13,738 as measured by GPC.

EXAMPLE IV

An illustrative photoresponsive imaging device incorporating the blocking layer of the present invention was fabricated as follows.

A 75 micron thick titanized MYLAR® substrate was coated by known draw bar techniques with a hole blocking layer from a solution of 1.6 grams of polymer (III-a) of Example I and 0.4 gram of 3-aminopropyl trimethoxysilane in 8 grams of a 96.0/1.5/2.5 (by weight percent) of a mixture of ethanovacetic acid/water. After drying at 135° C. for 1 minute, a blocking layer (HBL) of about 3.4 to about 3.9 microns was obtained. Overcoated on the top of the blocking layer was a 0.05 micron thick adhesive layer prepared from a solution of 2 weight percent of an E.I. DuPont 49K (49,000) polyester in dichloromethane. A 0.2 micron photogenerating layer was subsequently coated on top of the adhesive layer from a dispersion of hydroxy gallium phthalocyanine Type V (0.46 gram) and a polystyrene-b-polyvinylpyridine block copolymer (0.48 gram) in 20 grams of toluene, followed by drying at 10° C. for 10 minutes. Subsequently, a 25 micron charge transport layer (CTL) was coated on top of the photogenerating layer from a solution of N,N'-diphenyl-N,N-bis(3-methyl phenyl)-1,1'-biphenyl-4,4'-diamine (2.64 grams) and a polycarbonate (3.5 grams) in 40 grams of dichloromethane.

A control device was also prepared in a similar manner without the above blocking layer.

The xerographic electrical properties of the imaging members can be determined by known means, including as indicated herein electrostatically charging the surfaces thereof with a corona discharge source until the surface potentials, as measured by a capacitively coupled probe attached to an electrometer, attained an initial value $V_o$ of about −800 volts. After resting for 0.5 second in the dark, the charged members attained a surface potential of $V_{ddp}$, dark development potential. Each member was then exposed to light from a filtered Xenon lamp with a XBO 150 watt bulb, thereby inducing a photodischarge which resulted in a reduction of surface potential to a $V_{bg}$ value, background potential. The percent of photodischarge was calculated as $100\times(V_{ddp}-V_{bg})/V_{ddp}$. The desired wavelength and energy of the exposed light was determined by the type of filters placed in front of the lamp. The monochromatic light photosensitivity was determined using a narrow band-pass filter.

The following table summarizes the electrical performance of these devices, which shows the effective blockage of dark charge injection by the hole blocking layer (HBL) of the present invention. Specifically, while the dark development potential ($V_{ddp}$), the half discharge exposure energy ($E_{1/2}$), and the residual voltage are similar for the control device and the device of the present invention, the dark decay, which measures the dark conductivity related to hole injection into the photogenerator layer, of the device of the present invention is significantly lower than that of the control device or photoconductive imaging member.

| Device # | CTL (μm) | Vddp (V) | E½ ergs/cm² | Dark Decay (V @ 500 ms) | Vr (V) |
|---|---|---|---|---|---|
| Control Device Without HBL | 25.0 | 813 | 1.54 | 19.5 | 0–4 |
| Device with 3.4–3.9 μm Crosslinked Siloxane HBL | 24.9 | 802 | 1.36 | 5.9 | 0–2 |

EXAMPLE V

A photoresponsive imaging device with a hole blocking layer of the present invention was fabricated in accordance with the procedure of Example IV except that the blocking layer was prepared from a solution of 1 gram of polymer (III-a) of Example I and 1 gram of 3-aminopropyltrimethoxysilane in 8 grams of a 90.0/3.8/6.2 (by weight percent) mixture of ethanol/acetic acid/water. After drying at 135° C. for 1 minute, a hole blocking layer (HBL) of about 2.5 to 3.3 microns was obtained. The following table summarizes the electrical performance of this device.

| Device # | CTL (μm) | Vddp (V) | E½ ergs/cm² | Dark Decay (V @ 500 ms) | Vr (V) |
|---|---|---|---|---|---|
| Control Device without HBL | 25.0 | 813 | 1.54 | 19.5 | 0–4 |
| Device with 2.5–3.3 μm Crosslinked Siloxane HBL | 24.3 | 807 | 1.40 | 8.8 | 0–5 |

EXAMPLE VI

A photoresponsive imaging device with a hole blocking layer derived from polymer (III-a) of Example III was prepared in accordance with the procedure of Example V.

The HBL thickness was about 2 to 2.3 microns, and was, more specifically, prepared from a solution of 1 gram of polymer (III-a) of Example III and 1 gram of 3-aminopropyltrimethoxysilane in 8 grams of a 90.0/3.8/6.2 (by weight percent) mixture of ethanovacetic acid/water. After drying at 135° C. for 1 minute, a hole blocking layer (HBL) of about 2 to 2.3 microns was obtained. The following table summarizes the electrical performance of this device.

| Device # | CTL ($\mu$m) | Vddp (V) | $E_{1/2}$ ergs/cm$^2$ | Dark Decay (V @ 500 ms) | Vr (V) |
|---|---|---|---|---|---|
| Control Device without HBL | 25.0 | 813 | 1.54 | 19.5 | 0–4 |
| Device with 2.0–2.3 $\mu$m Crosslinked Siloxane HBL | 25.4 | 805 | 1.46 | 10.3 | 0–5 |

Other embodiments and modifications of the present invention may occur to those skilled in the art subsequent to a review of the information presented herein; these embodiments and modifications, as well as equivalents thereof, are also included within the scope of this invention.

What is claimed is:

1. A photoconductive imaging member comprised of an optional supporting substrate, a hole blocking layer thereover, a photogenerating layer, and a charge transport layer, and wherein the hole blocking layer is generated from crosslinking an organosilane (I) in the presence of a hydroxy-functionalized polymer (II)

(I)

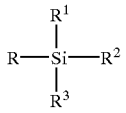

(II)

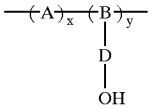

wherein R is alkyl or aryl, $R^1$, $R^2$, and $R^3$ are independently selected from the group consisting of alkoxy, aryloxy, acyloxy, halide, cyano, and amino; A and B are respectively divalent and trivalent repeating units of polymer (II); D is a divalent linkage; x and y represent the mole fractions of the repeating units of A and B, respectively, and wherein x is from about 0 to about 0.99, and y is from about 0.01 to about 1, and wherein the sum of x+y is equal to about 1.

2. An imaging member in accordance with claim 1 wherein said organosilane is selected from the group consisting of methyltrichlorosilane, methyltrimethoxysilane, methyltriethoxysilane, ethyltrichlorosilane, ethyltrimethoxysilane, ethyltriethoxysilane, propyltrimethoxysilane, 3-aminopropyltrimethoxysilane, and 3-aminopropyltriethoxysilane.

3. An imaging member in accordance with claim 1 wherein A is selected from the group consisting of

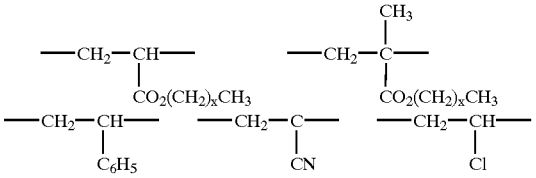

wherein x represents the number of repeating segments, and B is selected from the group consisting of

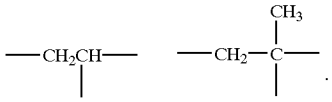

4. An imaging member in accordance with claim 1 wherein D is arylene, aryleneoxycarbonyl, or alkyleneoxycarbonyl.

5. An imaging member in accordance with claim 1 wherein polymer (III) is selected as the hydroxyfunctionalized polymer (II)

(III)

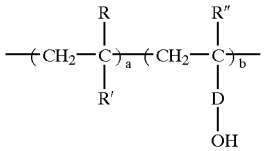

wherein R and R" are independently selected from the group consisting of hydrogen, alkyl, aryl, and halogen or halide; R' is aryl, cyano, halogen, alkoxycarbonyl, aryloxycarbonyl; D is divalent linkage optionally selected from the group consisting of arylene, alkylenearyl, alkyleneoxycarbonyl, aryleneoxycarbonyl, and alkylenearyloxycarbonyl; and a and b represent mole fraction numbers of the repeating units of the polymer wherein the sum of a+b is equal to 1.

6. An imaging member in accordance with claim 1 wherein a is a number or fraction thereof of from about 0 to about 0.99, and b is a number or fraction thereof of from 0.01 to about 1.

7. An imaging member in accordance with claim 5 wherein R and R" are independently selected from the group consisting of hydrogen and alkyl, and R' is alkoxycarbonyl.

8. An imaging member in accordance with claim 7 wherein R' is methoxycarbonyl, ethoxycarbonyl, propoxycarbonyl, or butoxycarbonyl.

9. An imaging member in accordance with claim 7 wherein D is alkyleneoxycarbonyl or alkylenearyloxycarbonyl.

10. An imaging member in accordance with claim 5 wherein the $M_n$ of (III) is from about 1,000 to about 50,000, and the $M_w$ thereof is from about 10,000 to about 200,000, or wherein the $M_n$ Of (III) is from about 5,000 to about 20,000, and the $M_w$ thereof is from about 15,000 to about 75,000.

11. An imaging member in accordance with claim 5 wherein said organosilane (I) is selected from the group consisting of methyltrichlorosilane, methyltrimethoxysilane, methyltriethoxysilane, ethyltrichlorosilane, ethyltrimethoxysilane, ethyltriethoxysilane, propyltrimethoxysilane, 3-aminopropyltrimethoxysilane, and 3-aminopropyl triethoxysilane.

12. An imaging member in accordance with claim 1 wherein said organosilane (I) is 3-aminoalkyltrialkoxysilane.

13. An imaging member in accordance with claim 1 wherein said organosilane (I) is 3-aminopropyltrialkoxysilane.

14. An imaging member in accordance with claim 1 wherein said organosilane (I) is 3-aminopropyltrimethoxysilane or 3-aminopropyltriethoxysilane.

15. An imaging member in accordance with claim 14 wherein alkyl contains from about 1 to about 15 carbon atoms, or wherein alkyl contains from about 1 to about 10 carbon atoms, and wherein alkoxy contains from about 1 to about 10 carbon atoms.

16. An imaging member in accordance with claim 5 wherein said hydroxy-functionalized polymer (III) is selected from the group consisting of (III-a) through (III-h).

17. A photoconductive imaging member in accordance with claim 16 wherein (III-a), (III-b), or (III-c) is selected, and wherein a and b are each from about 0.2 to about 0.8, or wherein (III-d), (III-e), (III-f), (III-g), or (III-h) is selected, and wherein a and b are each from about 0.2 to about 0.8.

18. A photoconductive imaging member in accordance with claim 16 wherein said organosilane (I) is 3-aminopropyltrimethoxysilane, or 3-aminopropyltriethoxysilane.

19. A photoconductive imaging member in accordance with claim 1 wherein said hole blocking layer is of a thickness of about 0.001 to about 5 microns.

20. A photoconductive imaging member in accordance with claim 1 wherein said hole blocking layer is of a thickness of about 0.1 to about 5 microns, and optionally wherein said layer is a two-phase layer wherein a hydroxy polymer is dispersed in a crosslinked polymer matrix.

21. A photoconductive imaging member in accordance with claim 1 comprised in the following sequence of a supporting substrate, said hole blocking layer, an adhesive layer, a photogenerating layer, and wherein the charge transport layer is a hole transport layer.

22. A photoconductive imaging member in accordance with claim 21 wherein the adhesive layer is comprised of a polyester with an $M_w$ of about 70,000, and an $M_n$ of about 35,000.

23. A photoconductive imaging member in accordance with claim 1 wherein the supporting substrate is comprised of a conductive metal substrate, and optionally which substrate is aluminum, aluminized polyethylene terephthalate or titanized polyethylene terephthalate.

24. A photoconductive imaging member in accordance with claim 1 wherein said photogenerator layer is of a thickness of from about 0.05 to about 10 microns, and wherein said transport layer is of a thickness of from about 10 to about 50 microns.

25. A photoconductive imaging member in accordance with claim 1 wherein the photogenerating layer is comprised of photogenerating pigments dispersed in a resinous binder in an optional amount of from about percent by weight to about 95 percent by weight, and optionally wherein the resinous binder is selected from the group consisting of polyesters, polyvinyl butyrals, polycarbonates, polystyrene-b-polyvinyl pyridine, and polyvinyl formals.

26. A photoconductive imaging member in accordance with claim 1 wherein the charge transport layer comprises aryl amines, and which aryl amines are optionally of the formula

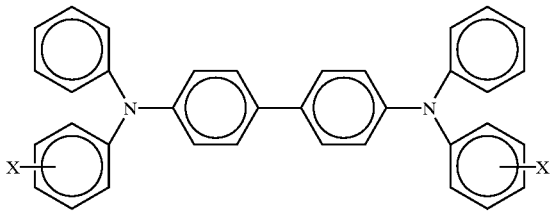

wherein X is selected from the group consisting of alkyl and halogen, and wherein the aryl amine is dispersed in a highly insulating and transparent resinous binder.

27. A photoconductive imaging member in accordance with claim 26 wherein alkyl contains from about 1 to about 10 carbon atoms, or wherein alkyl contains from 1 to about 5 carbon atoms, or optionally wherein alkyl is methyl, wherein halogen is chlorine, and wherein the resinous binder is selected from the group consisting of polycarbonates and polystyrenes.

28. A photoconductive imaging member in accordance with claim 27 wherein the aryl amine is N,N'-diphenyl-N, N-bis(3-methyl phenyl)-1,1'-biphenyl-4,4'-diamine.

29. A photoconductive imaging member in accordance with claim 1 wherein the photogenerating layer is comprised of metal phthalocyanines, or metal free phthalocyanines.

30. A photoconductive imaging member in accordance with claim 1 wherein the photogenerating layer is comprised of titanyl phthalocyanines, perylenes, or hydroxygallium phthalocyanines.

31. A photoconductive imaging member in accordance with claim 1 wherein the photogenerating layer is comprised of Type V hydroxygallium phthalocyanine.

32. A method of imaging which comprises generating an electrostatic latent image on the imaging member of claim 1, developing the latent image, and transferring the developed electrostatic image to a suitable substrate.

33. A photoconductive imaging member in accordance with claim 1 wherein there is accomplished a crosslinking in the presence of a catalyst optionally selected from the group consisting of carboxylic acids and amines.

34. A photoconductive imaging member in accordance with claim 33 wherein acetic acid or an alkylamine is selected as the catalyst.

35. A photoconductive imaging member in accordance with claim 33 wherein propylamine or butylamine is selected.

36. A photoconductive imaging member in accordance with claim 33 wherein the catalyst is selected in the amount of about 0.01 to about 10 weight percent of the amount of organosilane (I).

* * * * *